US006666253B2

(12) United States Patent
Herreid et al.

(10) Patent No.: US 6,666,253 B2
(45) Date of Patent: Dec. 23, 2003

(54) METHOD AND APPARATUS FOR MAKING A SAND CORE WITH AN IMPROVED HARDENING RATE

(75) Inventors: Richard M. Herreid, Austin, MN (US); Yuliy M. Yunovich, Austin, MN (US); Jeremy D. Eastman, Austin, MN (US)

(73) Assignee: Hormel Foods, LLC, Austin, MN (US)

( * ) Notice: Subject to any disclaimer, the term of this patent is extended or adjusted under 35 U.S.C. 154(b) by 0 days.

(21) Appl. No.: 10/101,439

(22) Filed: Mar. 18, 2002

(65) Prior Publication Data

US 2003/0173049 A1 Sep. 18, 2003

(51) Int. Cl.[7] ..... B22C 7/06; B22C 9/12

(52) U.S. Cl. ..... 164/20; 164/12; 164/29; 164/369

(58) Field of Search ..... 164/12, 20, 29, 164/525, 529, 369

(56) References Cited

U.S. PATENT DOCUMENTS

| | | | | | |
|---|---|---|---|---|---|
| 4,064,926 | A | * | 12/1977 | Naegele | 164/154.8 |
| 4,158,381 | A | * | 6/1979 | Michelson | 164/226 |
| 5,365,995 | A | * | 11/1994 | Warner | 164/12 |
| 5,715,885 | A | * | 2/1998 | Nagarwalla et al. | 164/20 |
| 6,505,671 | B1 | * | 1/2003 | McKibben et al. | 164/12 |

* cited by examiner

*Primary Examiner*—M. Alexandra Elve
*Assistant Examiner*—Len Tran
(74) *Attorney, Agent, or Firm*—IPLM Group, P.A.

(57) ABSTRACT

The present invention relates to a method and apparatus for making a sand mold (112) utilizing reverse purge air through a core box (100 and 100') to harden the binder in the sand mold (112) proximate the ejection pins (106 and 106'). The sand mold (112) may be removed from the core box (100 and 100') prior to drying the binder completely.

12 Claims, 3 Drawing Sheets

FIG. 1
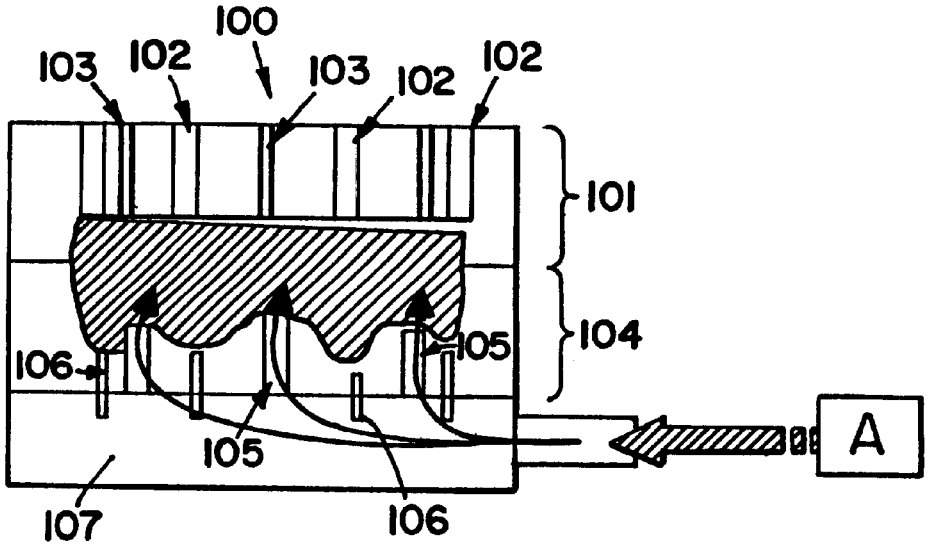
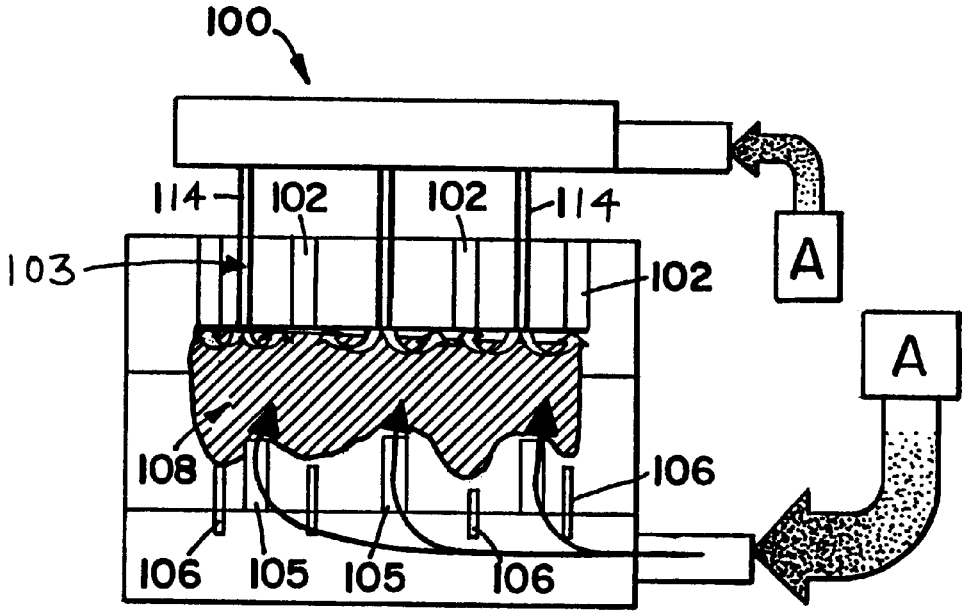
FIG. 2

FIG. 3
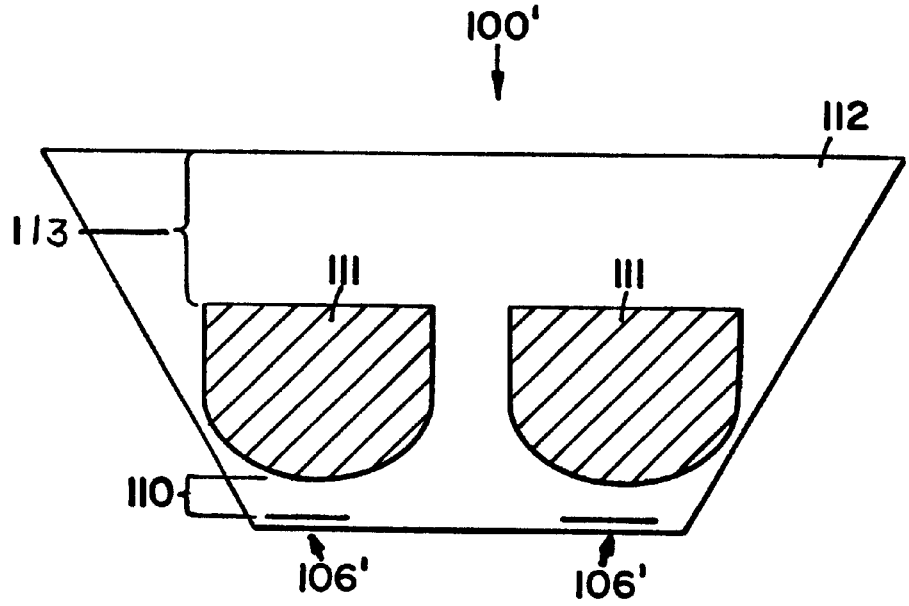
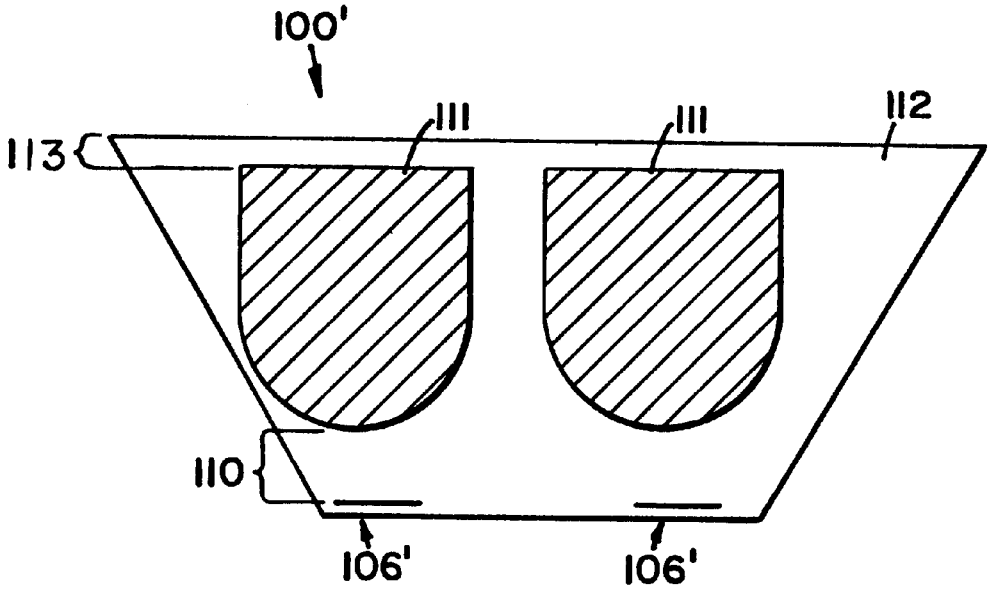
FIG. 4

METHOD AND APPARATUS FOR MAKING A SAND CORE WITH AN IMPROVED HARDENING RATE

BACKGROUND OF THE INVENTION

1. Field of the Invention

The present invention relates to a method and apparatus for making a sand core with an improved hardening rate.

2. Description of the Prior Art

Cores and molds used in metal casting consist of a mass of refractory aggregate bound together to form a shape used as a pattern for molten metal during the casting process. The aggregate is typically coated with a binding material and then formed into a shape using a pattern. The binding material is typically hardened to hold the aggregate in the desired shape so the core or mold can be removed from the pattern. The core or mold is then used in giving shape to molten metal so that the metal takes the shape of the original pattern when the metal cools. In common usage, the mold forms the outer surface of the casting and the cores are used to form interior passages in the casting.

The most successful current method for manufacturing cores uses a reactive chemical binder to coat a refractive aggregate such as silica sand. The binder coated sand is blown with air from a sand magazine into a core box having a cavity with a surface of the desired pattern to be used to form the core. The core box also includes vents, which are small openings extending through the core box into the cavity allowing air but not sand to pass through the cavity. Thus the air used to blow the sand into the pattern can escape the cavity while the sand is retained and fills the cavity pattern of the core box. The binder on adjacent sand grains must then be solidified at the contact points between sand grains to ensure that the sand holds the shape of the pattern once the sand core is removed from the core box. The solidification of the binder is often accomplished by passing reactive gas through the sand that reacts with the binder or catalyzes a hardening reaction. Typical examples are amine vapor used to harden phenolic urethane binders and sulfur dioxide gas used to harden acrylic/epoxy binders. Once the reaction has taken place, the reactive gas is usually purged from the core with air. Another type of binder is disclosed in U.S. Pat. No. 5,582,231 to Siak et al. where the hardening of the binder occurs by removal of moisture from the binder.

Typically the core box is divided into two sections which can be opened to remove the core after it has hardened to take the shape of the pattern in the internal cavity of the core box. The division of the core box can be along the horizontal axis where the upper part of the core box is called the cope and the lower part of the core box is called the drag. The division of the core box on the vertical axis results in a left part and a right part of the core box. It is usual for core boxes to have ejection pins along portions of the cavity surface to assist in removing the hardened cores from the core box when the core box parts are separated. These pins are metal rods, of which the ends are flush with the pattern surface of the core box cavity when the core box is closed and the sand is being blown into the box. When the box is opened the pins push against the surface of the core to remove it from the pattern. The pins can be spring-loaded, mechanically forced, or otherwise constructed by suitable means in the art to eject the core. Depending on the shape of the pattern, the ejection pins may be required to exert significant force on the surface of the core. In the drag the pins also support the weight of the core to lift it out of the core box so it can readily be removed from the core box.

The standard procedure for the introducing gas or air into the core box is to use a gassing manifold on the top of the box and an exhaust manifold on the bottom of the box. The gas and/or air passes from the top of the box where it is usually introduced through the blow holes through which the sand is blown into the core box or through vents in the upper surface of the core box. This is an efficient way to introduce reactive gas and purge air in core boxes using these binder systems. A noxious gas such as amine vapor and purge air containing traces of amines pass from the top of the core box, through the core contained within the cavity of the core box, and into the exhaust manifold where it can be collected and directed to a scrubber to remove the noxious gas from the air.

U.S. Pat. No. 5,582,231 to Siak et al. discloses the use of standard core blowing equipment and air to dry the sand core. Traditional core machines are those with purge air flow from the top of the core box to the bottom as described above and as shown in ASM Handbook® (Formerly Ninth Edition, Metals Handbook) Volume 15, "Casting" (1988). However, in the binding system which uses air to remove moisture from the binder to cause hardening (e.g. U.S. Pat. No. 5,582,231), this top to bottom air flow results in an inefficient core making process. The dry air introduced at the top of the core box will become saturated with moisture as it travels down through the hydrated sand in the core. Thus the lower part of the core will be the last part to be dried and hardened because the moisture is pushed downward. In practice this means that a large amount of the total moisture in the core must be removed before the bottom core surface is strong enough to support the force of the ejection pins without breaking and ruining the core when the core box is opened to remove the core. The rate at which cores can be made and removed from the core box, referred to as cycle time, is very important in determining the cost of a core making process. Long cycle times require more capital expense in more core boxes and core machines to produce a given number of cores in a given period of time.

SUMMARY OF THE INVENTION

In a preferred embodiment method of making a sand core, a core box having a cope and a drag defining a cavity is obtained. The cope includes cope vent holes and blow holes, and the drag includes drag vent holes, an exhaust manifold, and ejection pins. The exhaust manifold is in fluid communication with the drag vent holes, and the cope vent holes and the drag vent holes allow access to the cavity. Binder coated aggregate that hardens with removal of moisture is blown into the cavity via the blow holes. An air source is connected to the exhaust manifold. Air is allowed to flow into the exhaust manifold and air is exhausted through the cope thereby allowing air to flow through the drag vent holes into the cavity to contact the binder coated aggregate. The binder coated aggregate proximate the ejection pins is dried to create a core with a hardened shell. The core is then ejected from the core box before the core is completely dry without breaking the hardened shell proximate the ejection pins.

In another preferred embodiment method of making a sand core, a core box having a cope and a drag defining a cavity is obtained. The cope includes cope vent holes, blow holes, and cope ejection pins. The drag includes drag vent holes, an exhaust manifold, and drag ejection pins. The exhaust manifold is in fluid communication with the drag vent holes. The cope ejection pins, the cope vent holes and the drag vent holes allow access to the cavity. Binder coated aggregate is blown into the cavity via the blow holes. An air source is connected to the cope ejection pins and the exhaust manifold. Air is allowed to flow through the cope ejection pins and through the exhaust manifold and air is exhausted through the cope thereby allowing air to flow through the drag vent holes into the cavity to contact the binder coated aggregate. The binder coated aggregate is dried proximate the cope ejection pins and the drag ejection pins to create a core with a hardened cope shell and a hardened drag shell. The core is ejected from the core box with the cope ejection pins and the drag ejection pins before the core is completely dry without breaking the hardened cope shell and the hardened drag shell.

In another preferred embodiment method of making a sand core in a core box, the core box has a cope, a drag, and ejection pins. The cope and the drag define a cavity. The cope includes cope vent holes and blow holes, and the drag includes drag vent holes and an exhaust manifold. The exhaust manifold is in fluid communication with the drag vent holes. The ejection pins, the cope vent holes, and the drag vent holes allow access to the cavity. Binder coated aggregate is hydrated and blown into the cavity via the blow holes. An air source is connected to the ejection pins and the exhaust manifold. Air is allowed to flow through the ejection pins and through the exhaust manifold for 2 minutes or less thereby allowing air to flow through the drag vent holes into the cavity to contact the binder coated aggregate. The air is exhausted through the cope vent holes. The binder coated aggregate is dried to create a core with a hardened shell proximate the ejection pins, and the core is ejected from the core box before the core is completely dry without breaking the hardened shell.

In another preferred embodiment method of making a sand core, hydrated gelatin coated sand is blown into a core box having ejection pins. Air is directed through the gelatin coated sand proximate the ejection pins for approximately 2 minutes or less to create a core with a hardened shell having a thickness of approximately ½ inch thick or greater. The core is ejected from the core box before the core is completely dry without breaking the hardened shell. The core is then dried completely in an outside heating source.

In a preferred embodiment system used for making a sand core, a core box has a cope and a drag defining a cavity. The cope includes cope vent holes, and the drag includes drag vent holes, an exhaust manifold, and ejection pins. The exhaust manifold is in fluid communication with the drag vent holes, and the cope vent holes and the drag vent holes allow access to the cavity. An air supply is operatively connected to the exhaust manifold, and the air supply blows air into the cavity through the drag vent holes proximate the ejection pins.

In a preferred embodiment method of making a sand core, a core box having a cope and a drag is obtained. The cope and the drag define a cavity. The cope includes cope vent holes and blow holes, and the drag includes drag vent holes, an exhaust manifold, and ejection pins. The exhaust manifold is in fluid communication with the drag vent holes. The cope vent holes and the drag vent holes allow access to the cavity. Hydrated gelatin coated sand that hardens with removal of moisture is blown into the cavity via the blow holes. An air source is connected to the exhaust manifold. Air is allowed to flow into the exhaust manifold and air is exhausted through the cope thereby allowing air to flow through the drag vent holes into the cavity to contact the hydrated gelatin coated sand. The hydrated gelatin coated sand proximate the ejection pins is dried to create a core with a hardened shell. The core is ejected from the core box before the core is completely dry without breaking the hardened shell proximate the ejection pins.

BRIEF DESCRIPTION OF THE DRAWINGS

FIG. 1 is a schematic view of a core box with reverse air flow according to the principles of the present invention;

FIG. 2 is another schematic view of the core box shown in FIG. 1 with air flow from the top and the bottom of the core box according to the principles of the present invention;

FIG. 3 is a cross-section view of a partially dried core with air flow from only the top of the core box;

FIG. 4 is another cross-section view of the partially dried core shown in FIG. 3 with air flow from the bottom of the core box.

DETAILED DESCRIPTION OF THE PREFERRED EMBODIMENT

Figure 5:
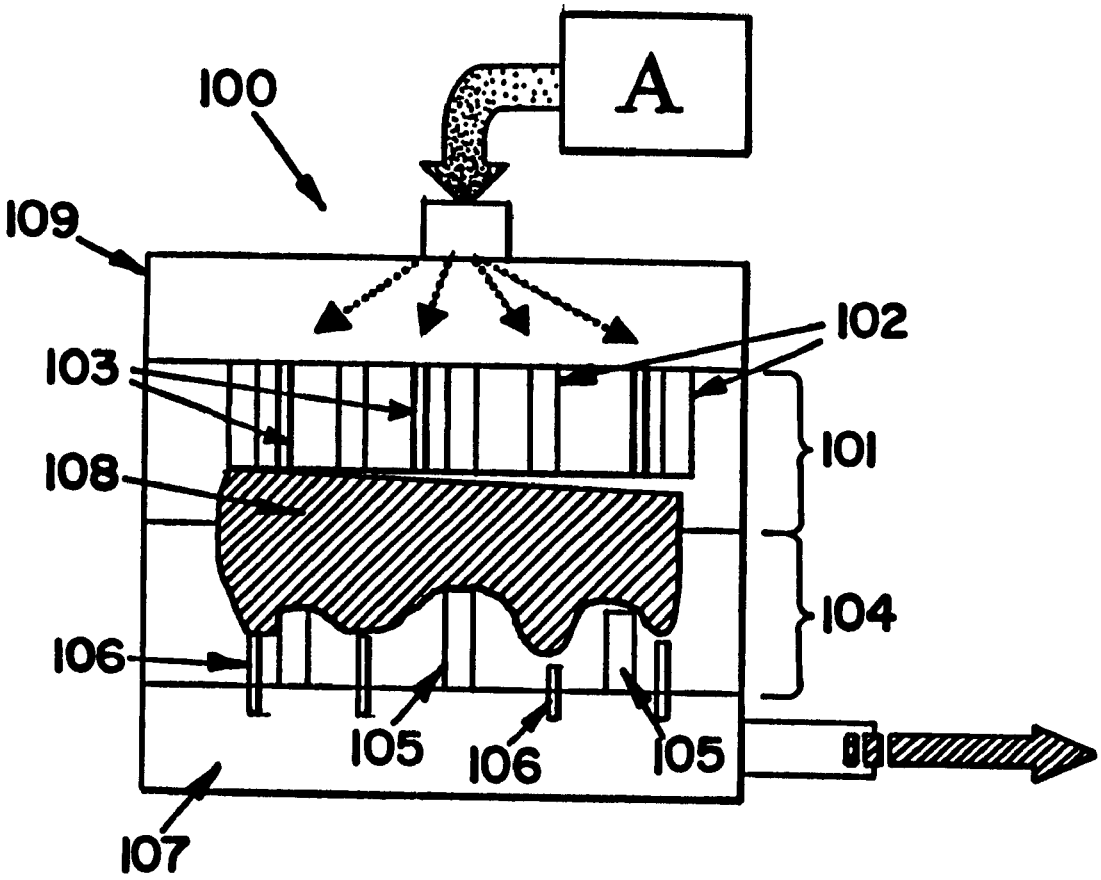
FIG. 5 is a schematic view of a core box with standard air flow for a typical commercial core machine.

The present invention relates to a method and apparatus for making a sand core. A typical commercial core box is designated by numeral 100 in FIGS. 1, 2, and 5. FIG. 5 shows the standard air flow from the top to the bottom for the typical core box 100. FIG. 1 shows reverse air flow from the bottom to the top while FIG. 2 shows air flow from both the top and the bottom. Cross-section views of partially dried cores are shown in FIGS. 3 and 4 in a core box designated by the numeral 100'.

In the following description of the preferred embodiment, sand is the aggregate used to describe the invention but the invention can be used with any refractory aggregate such as ceramic or synthetic beads or other aggregates known in the art. In addition, the binder used to coat the aggregate is gelatin in the preferred embodiment, but other types of binders such as sodium silicate or other binders known in the art could also be used as long as the binder coated aggregate hardens with the removal of moisture from the binder to bind the aggregate particles together. Although the preferred embodiment utilizes gelatin coated sand particles, such as disclosed in U.S. Pat. No. 5,582,231 to Siak et al., which is incorporated by reference herein, other bonding agents well known in the art could be used with the present invention. A mold box is essentially a larger core box. Also, it is recognized that both sand molds and sand cores could be made using the present invention. The mechanism used to bind the sand into a shape is the same for molds and cores so the terms are used interchangeably throughout the specification, and it is understood that the use of either term does not limit the scope of the invention to one or the other. In particular, the present invention is useful for larger sand molds or sand cores that typically take longer to bind or dry. However, the present invention is equally useful for smaller sand molds or sand cores.

The preferred embodiment core boxes 100 shown in FIGS. 1, 2, and 5 includes a cope 101, which is the top portion, and a drag 104, which is the bottom portion. The core box 100 shown and described for the prior art and the preferred embodiment of the invention is horizontally divided, but it is understood that the invention also applies to core boxes that are vertically divided. The cope 101 and the drag 104 form a cavity 108, and the cavity 108 is where the binder coated aggregate is placed to form the core. The vents 102 in the cope 101 and the vents 105 in the drag 104 provide access to the cavity 108 and are small openings through which air but not sand can move. The cope 101 also includes blow holes 103 through which the binder coated aggregate is blown into the cavity 108 to form the core. The drag 104 also includes an exhaust manifold 107 in fluid communication with the vents 105. Typically, as sand is blown into the blow holes 103 with air, the air exits through the exhaust manifold 107.

The cope 101 has vents 102 and blow holes 103 through which air or gas is typically circulated into the core box 100 from air or gas source A through the gassing manifold 109 which is in fluid communication with the cope vents 102. A vacuum source is typically connected to the exhaust manifold 107 to draw out the air or gas that has entered the cavity 108 from the vents 102 and dispose of the air or gas. The drag 104 has vents 105 through which air or gas is normally circulated out of the core box 100 through the exhaust manifold 107. This is shown in FIG. 5.

In the present invention, as shown in FIGS. 1 and 2, the vacuum source has been disconnected and an air source A has been connected to the exhaust manifold 107. After the sand has been blown into the cavity 108, the air source A may be connected and air allowed to flow through the exhaust manifold 107 thereby drying the sand from the bottom. In FIGS. 1 and 2, ejection pins 106 are located along the drag 104 to eject the core from the core box 100. Ejection pins 114, shown in FIG. 2, are located along the cope 101 to eject the core from the core box 100. Typically, ejection pins are steel rods, but the ejection pins of the preferred embodiment have been modified. The modified ejection pins 106 are hollow tubes with vents on the ends of the pins against the surface of the cavity 108. The term "vents" is used generically to describe vents in the core box itself and vents in the hollow ejection pins. The vents in either instance could be screen baffles that prevent sand but allow air to flow through the vents, and it is recognized that any type of vent known in the art could be used. The drag ejection pins 106 may be of any length and placed along the drag 104 in numerous locations to accommodate various sizes and shapes of molds. The cope ejection pins 114 may be of any length and placed along the cope 101 in numerous locations to accommodate various sizes and shapes of molds. The cope ejection pins 114 are shown aligned with the blow holes 103 in FIG. 2, but it is understood that the cope ejection pins 114 may be independent of the blow holes 103 similar to the drag ejection pins 106.

FIG. 1 shows the air source A blowing air into the core box 100 from the drag 104, and FIG. 2 shows the air source A blowing air into the core box 100 from the cope ejection pins 114 and the drag 104. Air may be blown into the core box 100 through both the ejection pins in the cope 114 and the drag 106 as well as through the vents 105 in the drag 104 and the air is exhausted through the vents 102 in the cope 101. If air cannot escape through the vents 102 in the cope 101, then air cannot escape the core box 100 and the core will not dry properly. Air could also be exhausted through the blow holes 103 and the hollow ejection pins, if present, in the cope 101. An example of a core box that could be used produces a generally rectangular, 12 pounds core for the interior of an electric box. The core box was manufactured by Winona Pattern and is operated with a Redford HCB22 core machine, but it is recognized that other suitable core-making equipment known in the art could be used.

The core cross-section in the core box 100' shown in FIG. 3 shows a partially dried gelatin coated sand core 112 that has been dried with air entering the core box 100' from the cope 101. FIG. 3 shows the prior art that would be made with core box shown in FIG. 5. When air is blown into the core box 100' through the cope 101 only, a thicker top portion or shell 113 of the sand 112 is formed. This is because as the air enters the core box 100' from the cope 101, the water or moisture is pushed downward by the air thereby drying the top portion 113 faster than the bottom portion 110 of the sand 112. However, because the core box 100' is often heated, a thin shell of dried binder coated sand is formed proximate the core box cavity surface even though the air is bringing the moisture through the sand toward the bottom portion 110 of the core 112. However, the wet portions 111 of the sand are located relatively closer to the bottom portion 110 of the core proximate the ejection pins 106'. In ejecting the core, the thin shell 110 over the ejection pins can break thereby ruining the core. Therefore, the shell 113 located proximate the cope 101 is thicker than the shell 110 located proximate the drag 104.

The core 100' shown in FIG. 4 shows a cross-section of a partially dried sand core that has been dried with air entering the core box 100' from the drag 104. When air is blown into the core box 100' through the drag 104 only, a thicker bottom portion or shell 110 of the sand is formed. As the air enters the core box 100' from the drag 104, the water or moisture is pushed upward by the air thereby drying the bottom portion 110 faster than the top portion 113 of the sand. Therefore, the wet portions 111 of the sand are located relatively closer to the cope 101 than to the drag 104. However, because the core box 100' is often heated, a thin shell of dried binder coated sand is formed proximate the top portion 113 even though the air is bringing the moisture through the sand toward the top portion 113 of the core. Therefore, the shell 110 located proximate the drag 104 is thicker than the shell located proximate the cope 101. Because the bottom portion 110 is relatively thick, the ejection pins 106' of the core box 100' can eject the core before the core is completely dried without breaking the shell 110. The core can then be completely dried outside the core box 100'.

One goal of the present invention is to make quality sand cores and reduce the time needed within the core box before the cores are removed without ruining the core. This process allows removal of the cores from the core box sooner than the conventional process because the amount of moisture that must be removed in the core box is minimized. The core box tooling and core machine are very expensive, and this process increases the number of cores that can be made in each core box and core machine.

One way this can be accomplished is to reverse the normal flow of the purge air through the core box 100 as shown in FIG. 1. Reversing the normal flow of purge air by putting the purge/drying air through the exhaust vents 105 rather than through the vents 102 provides maximum core strength over the ejection pins 106. The purge air connection is removed from the gassing head 109 in the cope 101, as shown in FIG. 5, and connected to the core box exhaust manifold 107 in the drag 104, as shown in FIG. 1. With reversed purge air flow coming into the cavity 108 from the drag 104 of the core box 100, a thicker hard section or shell is formed over the ejection pins 106. This thicker shell prevents breakage of the core by the ejection pins 106 and allows removal of the core from the core box 100 while it still contains a significant amount of water. This speeds up the core making process because the core drying can be completed outside the core box 100 in an independent, outside heating source such as an oven or other drying instrument well known in the art. FIG. 4 shows the cross-section view of a core made with the process of this invention.

Another way this could be accomplished is to use drying air input from both the cope 101 and the drag 104 of the core box 100 to build stronger areas over both the upper ejection pins 114 and the lower ejection pins 106, if upper ejection pins are present. This is illustrated in FIG. 2. In some core boxes, there are ejection pins located at both the top and the bottom of the core box. In this instance, drying air can be introduced through the bottom vents 105 of the core box 100 as well as through hollow upper ejection pins 114 and hollow lower ejection pins 106. By adjusting the upper and lower air pressures and flows correctly, thicker shells form over both the upper and the lower ejection pins to maximize the core strength thereby increasing the production rate.

EXAMPLE 1

A core box with cavities for making two cylinder head valve train sand cores weighing 15 kg each was mounted on a FATA Peterle core machine designed for a standard phenolic urethane cold box core process. The air supplying the purge air manifold was dried and heated to facilitate moisture evaporation. The core box was heated with electrical heating elements. The core box was of the type horizontally divided with an upper section (cope) and lower section (drag). Both the cope and drag had slot vents that allowed air but not sand to pass through. The drag vents were open to an exhaust manifold that collected the air and/or gas exiting the drag and directed it to a scrubbing system. Instruments to measure air flow and moisture in the air were placed in the exhaust manifold outlet to measure the amount of moisture removed from the core during the drying/hardening process. The cope vents were on the top surface of the cope and were covered by the purge air manifold when the manifold was clamped in position on top of the core box. The cope and drag both had ejection pins, which pushed the core out of the cope and drag cavities as the core box opened. After the core box opened, the cores remained suspended on the drag ejection pins until they were removed from the core box. The cope section of the core box also contained blow holes through which sand was blown into the closed core box. The blow holes were in the top of the cope and were covered by the purge air manifold when it was in place on top of the core box. This core box set up is similar to that shown in FIG. 5.

Cores were made by blowing sand coated with a 1% gelatin binder and rehydrated with 2% water (both percentages based on the weight of sand) into the core box heated at about 140° C. using about 60 pounds per square inch (psi) air pressure. The sand magazine was moved away from the core box and the purge air manifold was clamped onto the top of the core box. After about a 90 second binder activation period, hot air at about 30 psi and 250° C. was directed through the purge air manifold, into the core box cope, through the core cavity, and discharged through the exhaust manifold for purge times specified in Table 1. The hot purge air was used to dry the binder causing it to harden and solidify the sand in the shape determined by the core box cavity. The conditions used to make cores and the results are in Table 1.

This example shows the results of using a standard core machine purge air process with air movement from the top of the core to the bottom of the core, which is hardened by removing moisture from the core binder, as is done in the prior art. Air purge times of greater than 3 minutes with total cycle times of about 5 minutes was required to form core with bottom surface strong enough to withstand drag ejection pin pressure.

TABLE 1

Top (Prior Art) Purge Air Process

| Test # | Purge Time (minutes) | Total Cycle Time (minutes) | % Moisture Removed | Core Quality |
|---|---|---|---|---|
| 1 | 3.0 | 4.0 | — | Core stuck in core box |
| 2 | 3.3 | 4.8 | 85% | Good cores |
| 3 | 3.3 | 5.8 | 78% | Good cores |
| 4 | 3.3 | 5.8 | 80% | Good cores |
| 5 | 2.5 | 4.7 | 63% | Broken lower surface - drag ejection pins penetrated core |

Samples of the cores were cut over the main drag ejection pin locations to expose the cross section at this location. The remaining loose, wet sand was removed to determine the amount of hardened sand shell over the ejection pins. The cores that were removed from the core box undamaged had a hardened sand shell at least ½ inch thick. Cores such as from Test 5 in Table 1 where the ejection pins penetrated the core surface ruining the core had hardened shells of about ¼ inch.

EXAMPLE 2

The same core box used in Example 1 was used, but the core box was set up with the purge air supply connected to the exhaust manifold, which supplied air to the drag vent openings of the bottom of the core box. The purge air left the core box through the cope vents on the top of the core box. This core box set up is shown in FIG. 1. The instruments used to measure air flow and air moisture content were not used as there was no common air manifold for the air leaving the core box. The cope ejection pins were used to partially block the blow holes in the top of the cope to minimize the amount of sand blown out of the blow holes during the air purge process.

Blowing the cylinder head valve train core as described in Example 1 until the modified purge air flow as described above gave the results shown in Table 2. Air purge pressure was about 15 psi and the activation time between core blowing and start of purge ranged from 1.5 to 2 minutes. "Shell Thickness" in Table 2 refers to the thickness of the hardened shell over the main drag ejection pins (on the bottom) and under the cope ejection pins (on the top) immediately after removal from the core box.

TABLE 2

Bottom Purge Air Process

| Test # | Purge Time (minutes) | Total Cycle Time (minutes) | Shell Thickness (inch) Bottom | Shell Thickness (inch) Top | Core Quality |
|---|---|---|---|---|---|
| 6 | 2.0 | 3.0 | 0.75 | 0.25 | Good cores |
| 7 | 1.5 | 3.0 | 0.50 | 0.25 | Good cores |

After modifying the ejection pins to completely block the blow holes in the cope, allowing more air pressure to be used, additional tests were run with purge air pressures ranging from about 15 psi to about 60 psi. The other conditions were the same as those used in tests reported in Table 2. The results of these additional tests are given in Table 3.

TABLE 3

Top and Bottom Purge Air Process

| Test # | Purge Time (minutes) | Total Cycle Time (minutes) | Purge Air Pressure (psi) | Core Quality |
|---|---|---|---|---|
| 8 | 1.7 | 2.17 | 60 | Good cores |
| 9 | 1.3 | 1.75 | 60 | Good cores |

The above specification, examples and data provide a complete description of the manufacture and use of the composition of the invention. Since many embodiments of the invention can be made without departing from the spirit and scope of the invention, the invention resides in the claims hereinafter appended.

We claim:

1. A method of making a sand core, comprising:

a) obtaining a core box, said core box having a cope and a drag, said cope and said drag defining a cavity, said cope including cope vent holes and blow holes, said drag including drag vent holes, an exhaust manifold, and ejection pins, said exhaust manifold being in fluid communication with said drag vent holes, said cope vent holes and said drag vent holes allowing access to said cavity;

b) blowing binder coated aggregate that hardens with removal of moisture into said cavity via said blow holes;

c) connecting an air source to said exhaust manifold;

d) allowing air to flow into said exhaust manifold and exhausting air through said cope thereby allowing air to flow through said drag vent holes into said cavity to contact said binder coated aggregate;

e) drying said binder coated aggregate proximate said ejection pins to create a core with a hardened shell; and f) ejecting said core from said core box before said core is completely dry without breaking said hardened shell proximate said ejection pins.

2. The method of claim 1, further comprising drying the ejected core completely with an independent heating source.

3. The method of claim 1, further comprising drying said binder coated aggregate to create said core with said hardened shell having a thickness of approximately ½ inch or greater.

4. The method of claim 3, further comprising drying said binder coated aggregate for 2 minutes or less to create said core.

5. The method of claim 1, further comprising allowing air to flow through said ejection pins thereby allowing air to flow into said cavity to contact said binder coated aggregate.

6. The method of claim 1, said binder being gelatin.

7. The method of claim 1, said aggregate being sand.

8. The method of claim 1, further comprising exhausting air through said cope vent holes.

9. The method of claim 1, further comprising exhausting air through said blow holes.

10. The method of claim 1, said cope including hollow cope ejection pins, further comprising exhausting air through said hollow cope ejection pins.

11. A system used for making a sand core, comprising:

a) a core box having a cope and a drag, said cope and said drag defining a cavity, said cope including cope vent holes, said drag including drag vent holes, an exhaust manifold, and hollow ejection pins, said exhaust manifold being in fluid communication with said drag vent holes and said ejection pins, said cope vent holes, said drag vent holes, and said ejection pins allowing access to said cavity; and b) an air supply operatively connected to said exhaust manifold, wherein said air supply blows air into said cavity through said drag vent holes and said ejection pins.

12. The system of claim 11, further comprising said air supply being operatively connected to said cope vent holes, wherein said air supply blows air into said cavity through said cope vent holes concurrently as air is blown into said cavity through said drag vent holes and said ejection pins.

* * * * *